US007903107B2

(12) United States Patent
Ostlund

(10) Patent No.: US 7,903,107 B2
(45) Date of Patent: Mar. 8, 2011

(54) ADAPTIVE REFRESH RATE FEATURES

(75) Inventor: Petter Ostlund, Lund (SE)

(73) Assignee: Sony Ericsson Mobile Communications AB, Lund (SE)

( * ) Notice: Subject to any disclaimer, the term of this patent is extended or adjusted under 35 U.S.C. 154(b) by 930 days.

(21) Appl. No.: 11/764,342

(22) Filed: Jun. 18, 2007

(65) Prior Publication Data

US 2008/0309652 A1 Dec. 18, 2008

(51) Int. Cl.
*G09G 5/00* (2006.01)

(52) U.S. Cl. ..... 345/211; 345/520

(58) Field of Classification Search ..... None
See application file for complete search history.

(56) References Cited

U.S. PATENT DOCUMENTS

| | | | | |
|---|---|---|---|---|
| 5,991,883 | A * | 11/1999 | Atkinson | 713/300 |
| 2004/0125099 | A1 | 7/2004 | Stanley et al. | |
| 2004/0252115 | A1 | 12/2004 | Boireau | |
| 2006/0146056 | A1* | 7/2006 | Wyatt | 345/501 |

FOREIGN PATENT DOCUMENTS

| | | | |
|---|---|---|---|
| EP | 1 122 953 | A2 | 8/2001 |
| EP | 1 640 951 | A2 | 3/2006 |
| WO | WO 03/100759 | A1 | 12/2003 |
| WO | WO 03100759 | A1 * | 12/2003 |

OTHER PUBLICATIONS

International Search Report and Written Opinion dated May 27, 2008 issued in corresponding PCT application No. PCT/IB2007/055172, 13 pages.

Written Opinion of the International Preliminary Examining Authority corresponding to PCT/IB2007/055172, dated Jun. 17, 2009, 7 pages.

* cited by examiner

*Primary Examiner* — Bipin Shalwala
*Assistant Examiner* — Kelly Hegarty
(74) *Attorney, Agent, or Firm* — Harrity & Harrity, LLP

(57) ABSTRACT

A device may include a display capable of providing variable refresh rates, and a display controller that determines a refresh rate and outputs an image to the display based on the determined refresh rate.

17 Claims, 6 Drawing Sheets

ADAPTIVE REFRESH RATE FEATURES

BACKGROUND

The proliferation of devices that incorporate some form of display, such as televisions, cameras, computer monitors, and portable devices, has become widespread. Despite variations that exist among these devices, they provide a platform to display various kinds of information. While technological advancements towards enhancing the clarity and resolution of display have emerged, and content formats have been standardized, the display quality of various kinds of image data remains problematic.

SUMMARY

According to one aspect, a device may include a display capable of providing variable refresh rates, and a display controller that determines a refresh rate and outputs an image to the display based on the determined refresh rate.

Additionally, the display controller may determine the refresh rate based on a property of the image.

Additionally, the display controller may determine the refresh rate based on format identifiers within the image.

Additionally, the display controller may determine the refresh rate based on a mode of the device.

Additionally, the display controller may determine the refresh rate based on execution of a software application.

Additionally, the device may include a power supply, where the display controller may determine the refresh rate based on a power level of the power supply.

Additionally, the display controller may include an adaptive refresh rate controller that scans the image and identifies a format of the image to determine the refresh rate.

Additionally, the display controller may include a memory that stores a database that stores a database that includes device mode information and corresponding refresh rates, and an adaptive refresh rate controller that references the memory to determine the refresh rate.

According to another aspect, a system may include a display capable of providing variable refresh rates, and a device that may include a display controller that determines a refresh rate and outputs an image to the display based on the determined refresh rate, where the display controller determines the refresh rate based on at least a property of the image.

Additionally, the display and the device may communicate with each other via a wireless connection.

Accordingly to yet another aspect, a method may include receiving an image with a device, determining a refresh rate from a plurality of refresh rates based on at least one of the image, a mode of the device, execution of software by the device, or a power level of a power supply of the device, and displaying the image on a display based on the determined refresh rate.

Additionally, the receiving an image may include scanning the image, and identifying a format identifier within the image.

Additionally, the determining a refresh rate may include calculating a multiple integer corresponding to an image format of the image.

Additionally, the determining a refresh rate may include converting the image to an identifiable image format, and calculating the refresh rate based on the identified image format of the image.

Additionally, the determining a refresh rate may include accessing a database comprising device modes and corresponding refresh rates.

Additionally, the determining a refresh rate may include accessing a database comprising software identification information and a corresponding refresh rates.

Additionally, the determining a refresh rate may include receiving a power level of the power supply of the device, and comparing the power level to a threshold value.

Additionally, the determining a refresh rate may include selecting a lowest refresh rate from the plurality of refresh rates when the power level is below the threshold value.

According to still another aspect, a computer-readable medium having stored thereon sequences of instructions which, when executed by at least one processor, may cause the at least one processor to determine a refresh rate from a plurality of refresh rates, and display an image based on the determined refresh rate.

According to yet another aspect, a device may include means for determining a refresh rate from a plurality of available refresh rates, and means for displaying an image at the determined refresh rate.

BRIEF DESCRIPTION OF THE DRAWINGS

The accompanying drawings, which are incorporated in and constitute a part of this specification, illustrate exemplary embodiments described herein and, together with the description, explain these exemplary embodiments. In the drawings.

DETAILED DESCRIPTION

The following detailed description refers to the accompanying drawings. The same reference numbers in different drawings may identify the same or similar elements. Also, the following detailed description does not limit the invention.

Overview

Implementations described herein may include a device capable of providing adaptive refresh rate features. In one implementation, for example, the device may include an adaptive refresh rate component. Additionally, the device may include a display (e.g., a portable device having a display, such as a mobile phone). Alternatively, the device may not include a display (e.g., a computer with a video card). In one example, the adaptive refresh rate component may calculate a refresh rate, and may correspondingly adapt the refresh rate of the display. In another example, the adaptive refresh rate component may calculate a refresh rate based on image data. In still another example, the adaptive refresh rate component may calculate a refresh rate based on indications from the device, such as indications pertaining to the mode of the device, indications pertaining to execution of a software application, and/or indications pertaining to a power level of a power source of the device.

"Image data," as the term is used herein, is to be broadly interpreted to include any information capable of being displayed on a display, such as still images (e.g., pictures) or motion images (e.g., video).

The description to follow will describe exemplary devices capable of providing adaptive refresh rate features, and a method for providing adaptive refresh rate features. In practice, implementations of a device and/or method may include, for example, hardware, software, combinations of hardware and software, and/or a hybrid architecture, in order to realize adaptive refresh rate features.

Exemplary Devices

Figure 1:
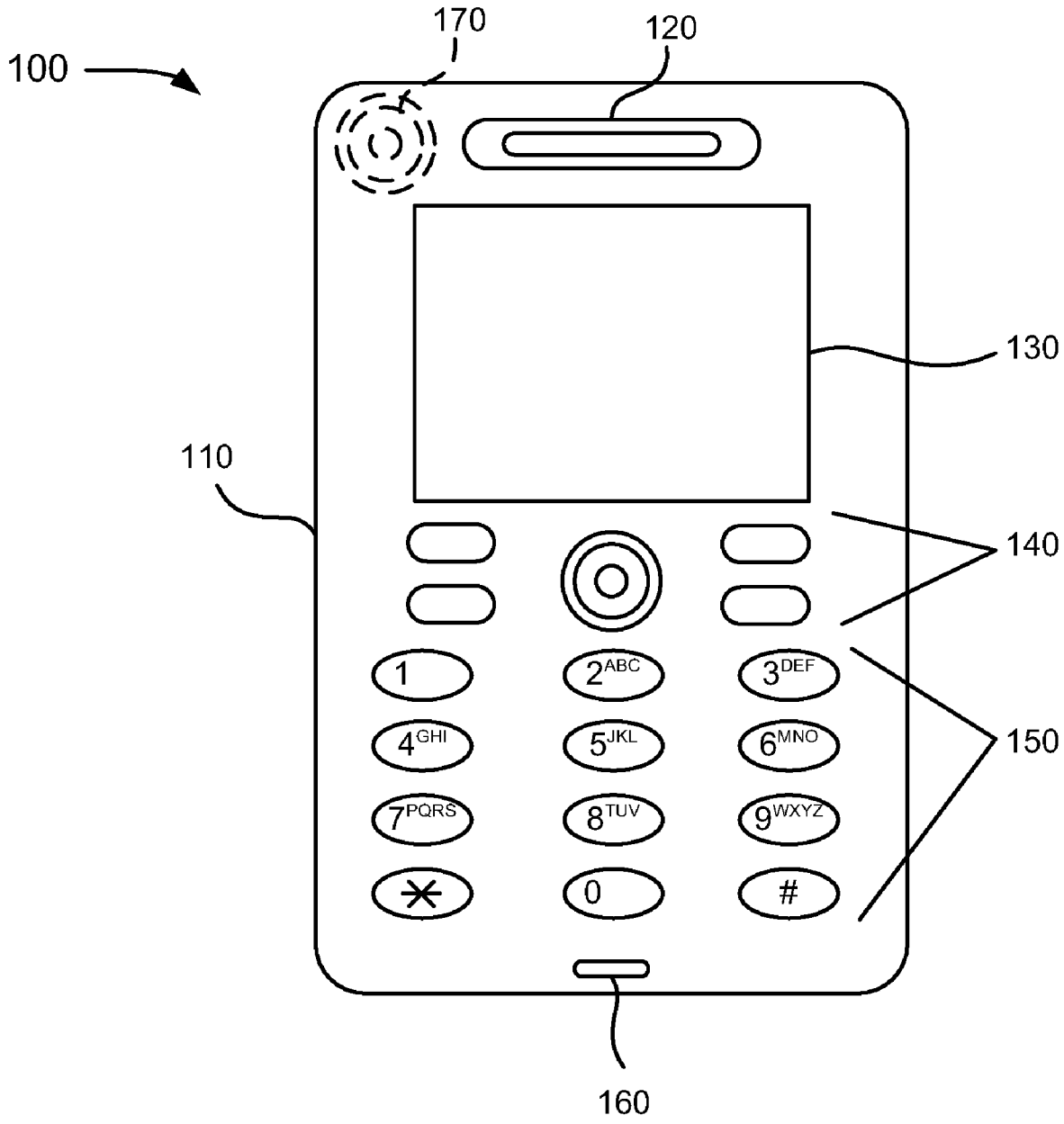
FIG. 1 is a front view of an exemplary device capable of providing adaptive refresh rate features according to implementations described herein.

FIG. 1 is a front view of an exemplary device 100. Device 100 may include one or more entities. An entity may be defined as a device, such as a telephone, a cellular phone, a personal digital assistant (PDA), or another type of computation or communication device, a thread or process running on one of these devices, and/or an object executable by one of these devices. In one implementation, device 100 may provide adaptive refresh rate features in a manner described herein. Further details of exemplary embodiments of device 100 are provided below.

As illustrated in FIG. 1, device 100 may include a housing 110, a speaker 120, a display 130, control buttons 140, a keypad 150, a microphone 160, and/or a camera 170. Housing 110 may protect the components of device 110 from outside elements. Speaker 120 may provide audible information to a user of device 100.

Display 130 may provide visual information to the user. For example, display 130 may display text, images, video, and/or graphics received from another device, such as a network, and/or information regarding incoming or outgoing calls or text messages, emails, media, games, phone books, address books, the current time, etc. Control buttons 140 may permit the user to interact with device 100 to cause device 100 to perform one or more operations. For example, control buttons 140 may be used to cause device 100 to transmit information. Keypad 150 may include a standard telephone keypad. Microphone 160 may receive audible information from the user. Camera 170 may be provided on a back side of device 100, and may enable device 100 to capture and/or store images.

Although FIG. 1 illustrates exemplary components of device 100, in other implementations, device 100 may contain fewer, different, or additional components than depicted in FIG. 1. In still other implementations, one or more components of device 100 may perform the tasks performed by one or more components of device 100.

Figure 2:
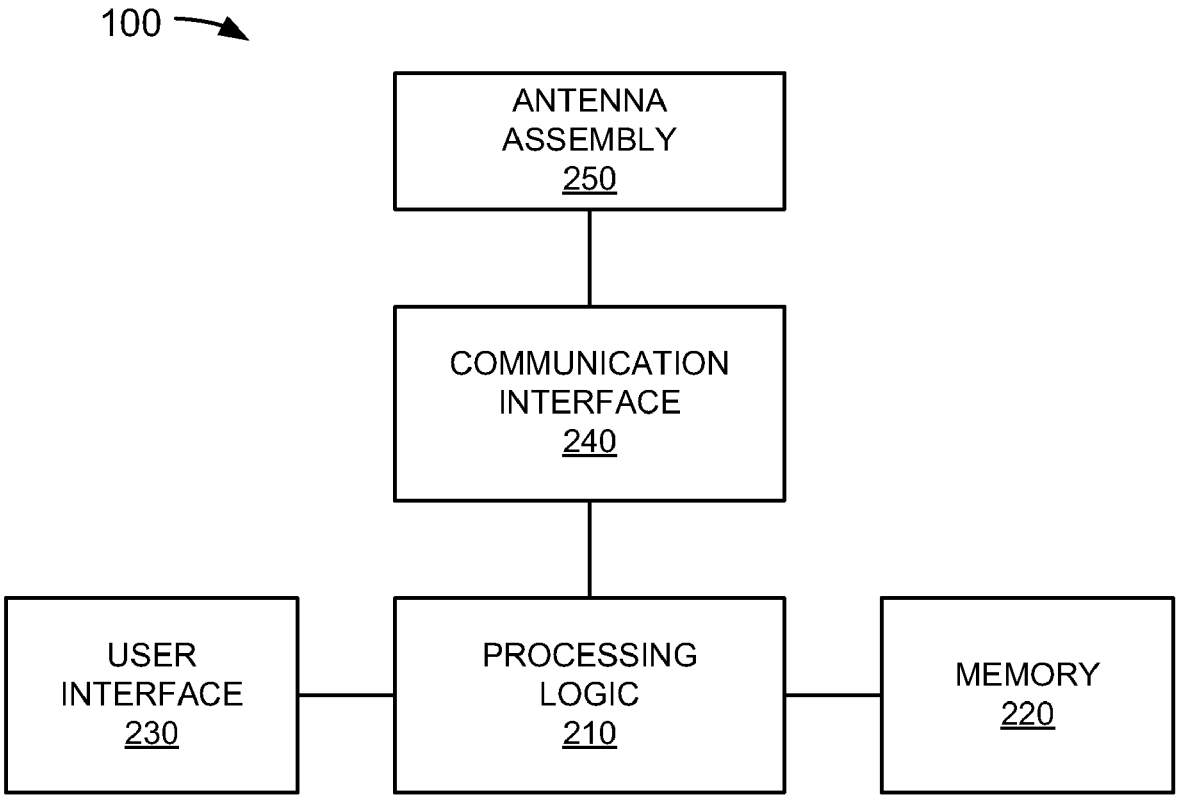
FIG. 2 is a diagram of exemplary components of the device of FIG. 1.

FIG. 2 is a diagram of exemplary components of device 100. As illustrated in FIG. 2, device 100 may include processing logic 210, memory 220, user interface 230, communication interface 240, and/or antenna assembly 250. Processing logic 210 may include a processor, a microprocessor, an application specific integrated circuit (ASIC), a field programmable gate array (FPGA), or the like. Processing logic 210 may control the operation of device 100 and its components. Memory 220 may include a random access memory (RAM), a read-only memory (ROM), and/or another type of memory to store data and instructions that may be used by processing logic 210.

User interface 230 may include mechanisms for inputting information to device 100 and/or for outputting information from device 100. Examples of input and output mechanisms might include buttons (e.g., control buttons 140, keys of keypad 150, a joystick, etc.) to permit data and control commands to be input into device 100; a speaker (e.g., speaker 120) to receive electrical signals and output audio signals; a microphone (e.g., microphone 160) to receive audio signals and output electrical signals; a display (e.g., display 130) to output visual information (e.g., text input into device 100); a vibrator to cause device 100 to vibrate; and/or a camera (e.g., camera 170) to capture image data.

Communication interface 240 may include, for example, a transmitter that may convert baseband signals from processing logic 210 to radio frequency (RF) signals and/or a receiver that may convert RF signals to baseband signals. Alternatively, communication interface 240 may include a transceiver to perform functions of both a transmitter and a receiver. Communication interface 240 may connect to antenna assembly 250 for transmission and/or reception of the RF signals. Antenna assembly 250 may include one or more antennas to transmit and/or receive RF signals over the air. Antenna assembly 250, may, for example, receive RF signals from communication interface 240 and transmit them over the air, and receive RF signals over the air and provide them to communication interface 240. In one implementation, for example, communication interface 240 may communicate with a network.

Although FIG. 2 illustrates exemplary components of device 100, in other implementations, device 100 may contain fewer, different, or additional components than depicted in FIG. 2. In still other implementations, one or more components of device 100 may perform the tasks performed by one or more components of device 100.

Figure 3:
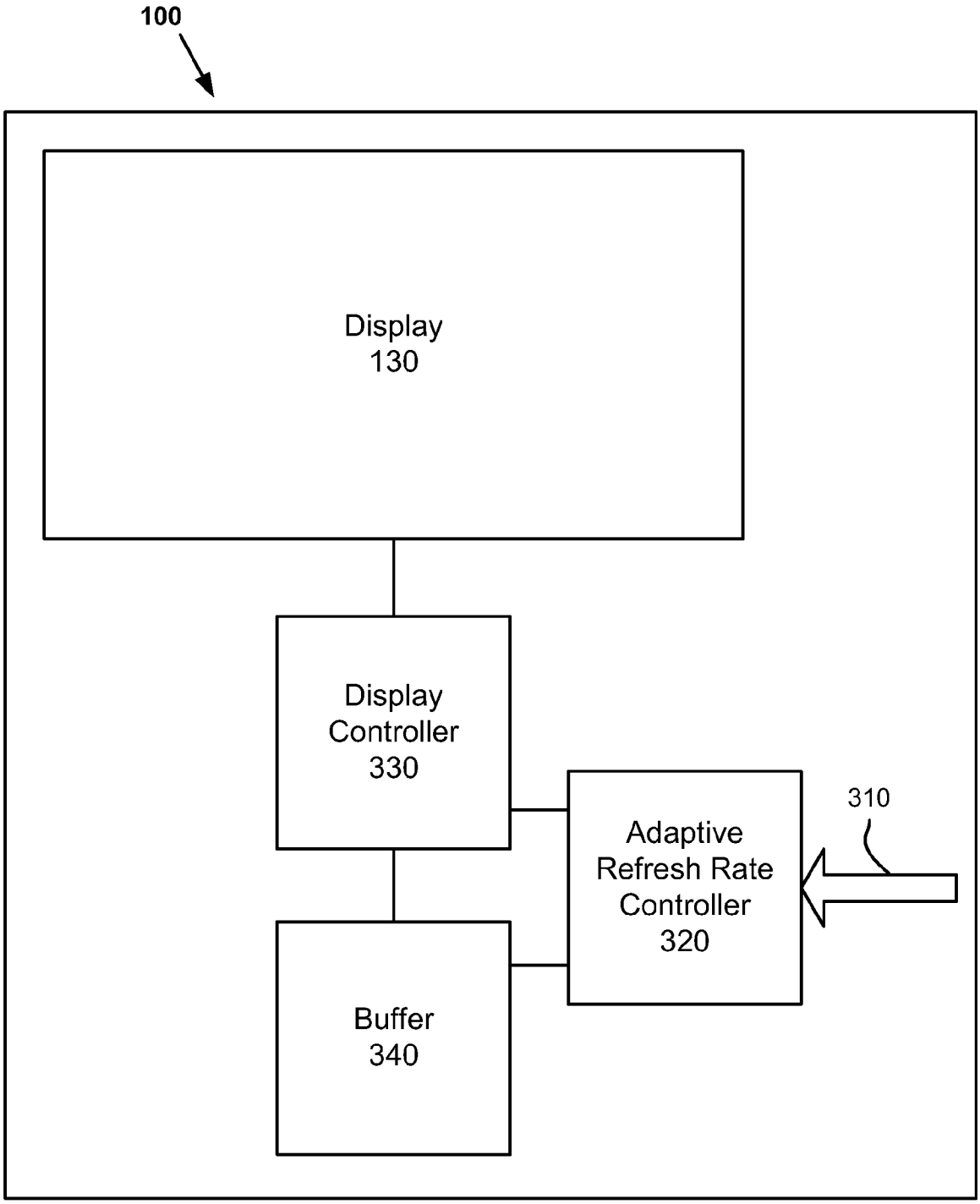
FIG. 3 is a diagram of a first exemplary implementation of the device depicted in FIG. 1.

FIG. 3 illustrates exemplary components of device 100 that may provide adaptive refresh rate features. As illustrated, device 100 may receive image data 310, and may include an adaptive refresh rate controller 320, a display controller 330, and/or a buffer 340. FIG. 3 further illustrates exemplary connections among adaptive refresh rate controller 320, display controller 330, buffer 340, and display 130. "Connections," as the term is used herein, is to be broadly interpreted to include a direct connection or an indirect connection between two or more components, unless explicitly stated otherwise. Although not illustrated, the exemplary connections may include additional components, such as multiplexers/de-multiplexers, analog-to-digital converters, digital-to-analog converters, and/or interface components.

It is to be understood that the components of device 100 may include other functional, operational, and/or structural components than those illustrated in FIG. 3. Also, two or more of the components may be implemented within a single component. For example, display controller 330 may include adaptive refresh rate controller 320. Conversely, a single component may be implemented as multiple components. For example, adaptive refresh rate controller 320 may include multiple, dedicated components corresponding to various, multiple operations that adaptive refresh rate controller 320 may perform. In an exemplary implementation, adaptive refresh rate controller 320, display controller 330 and buffer 340 may reside in user interface 230. In another exemplary implementation, adaptive refresh rate controller 320, display controller 330 and buffer 340 may reside in processing logic 210.

Image data 310 may include any information capable of being displayed by display 130. Image data 310 may be in raw form (e.g., unprocessed or minimally processed image data), in a standardized form (e.g., video formats, pictorial formats, textual formats, etc.), or in some other processed form. In one example, image data 310 may include digital image data and/or analog image data. In another example, image data 310 may be in a compressed format and/or an uncompressed format.

Adaptive refresh rate controller 320 may include any logic that adaptively controls the refresh rate of display controller 330 and/or display 130. "Logic," as the term is used herein, is to be broadly interpreted to include hardware (e.g., an application specific integrated circuit (ASIC), a field programmable gate array (FPGA), etc.), software, a combination of software and hardware, and/or a hybrid architecture. In one implementation, for example, adaptive refresh rate controller 320 may include a general purpose processor (e.g., a microprocessor) and/or a special purpose processor (e.g., a data processor, a co-processor, a video processor, a graphics processor, and/or a digital signal processor). In such implementation, adaptive refresh rate controller 320 may access instructions from an on-board memory, from other components of device 100, and/or from a source external to device 100 (e.g., a network or another device) to provide the adaptive refresh rate features described herein.

In one implementation, adaptive refresh rate controller 320 may calculate a refresh rate based on image data 310. For example, if image data 310 is formatted, adaptive refresh rate controller 320 may scan image data 310 and may calculate a refresh rate. In another example, if image data 310 is a composite video signal having a luminance signal, a chrominance signal, and/or a synchronization signal, adaptive refresh rate controller 320 may calculate a frames-per-second (fps) based on the periodicity of the synchronization signal within image data 310. In still another example, adaptive refresh rate controller 320 may determine that image data 310 includes a video format of 30 fps, and display 130 may have a variable refresh rate between 50-100 Hertz (Hz). Adaptive refresh rate controller 320 may calculate a refresh rate of 90 Hz, since 90 is an integer multiple of 30 (i.e., 3×30). In such implementation, adaptive refresh rate controller 320 may adaptively control the refresh rate of display 130 by providing this refresh rate to display controller 330. Such an approach may also apply to other types of video signals, such as a component video signal, where a synchronization signal may be present. Image data 310 (other than video) may include other types of format indicators, such as flags or identifiers that could be utilized by adaptive refresh rate controller 320 to calculate a refresh rate.

In another implementation, adaptive refresh rate controller 320 may calculate a refresh rate if image data 310 is minimally formatted and/or in a raw format. While raw formats may vary, in one example, at least some raw formats (e.g., a ".dng" format) may include header information and/or metadata (e.g., ".dng" tag information) that may permit adaptive refresh rate controller 320 to calculate a corresponding refresh rate. In still another implementation, adaptive refresh rate controller 320 may calculate a refresh rate by referring to a table that may include a cross-reference between type of image data 310 and a refresh rate. In yet another implementation, if adaptive refresh rate controller 320 is unable to discern the type of image data 310, adaptive refresh rate controller 320 may pass image data 310 to display controller 330 and/or buffer 340. In one example, display controller 330 may convert image data 310 in a raw format into image data 310 in a standardized format (e.g., ".tif" or ".jpeg" formats) or some other processed format. Adaptive refresh rate controller 320 may read buffer 340 to calculate a corresponding refresh rate based on the formatted and/or processed image data 310. Alternatively, adaptive refresh rate controller 320 may read an output of display controller 330 to display 130, and may calculate a corresponding refresh rate.

In yet another implementation, adaptive refresh rate controller 320 may calculate a refresh rate based on a mode of device 100. For example, adaptive refresh rate controller 320 may receive indications (e.g., from processing logic 210) that identify the mode of device 100. The mode of device 100 may provide information for adaptive refresh rate controller 320 to calculate a corresponding refresh rate. In one example, adaptive refresh rate controller 320 may calculate a refresh rate by referring to a table that includes a cross-reference between a mode of device 100 and a refresh rate. If device 100 includes an image-capturing component (e.g., camera 170), device 100 may include a camera mode, such that display 130 may be utilized as a viewfinder. In such an instance, adaptive refresh rate controller 320 may calculate a corresponding refresh rate. In another instance, if device 100 operates in a playback mode for displaying stored image data 310 (e.g., a video), adaptive refresh rate controller 320 may calculate a corresponding refresh rate. If display 130 displays semi-static information, such as time and date information, adaptive refresh rate controller 320 may calculate a corresponding refresh rate. The table discussed above is merely exemplary, and other data structures may be employed. Further, the table may be updatable.

In still another implementation, adaptive refresh rate controller 320 may calculate a refresh rate based on an indication of an execution of a software application. For example, processing logic 210 of device 100 or other components of device 100 may provide indications that software is loading. Adaptive refresh rate controller 320 may calculate a corresponding refresh rate based on this information. In one example, adaptive refresh rate controller 320 may refer to a table that includes a cross-reference between software (e.g., name or type) and a refresh rate.

In yet another implementation, adaptive refresh rate controller 320 may calculate a refresh rate based on power considerations. For example, adaptive refresh rate controller 320 may calculate a refresh rate based on indications (e.g., from processing logic 210 or a power source (e.g., a battery) of device 100) that a power supply is low (e.g., below a threshold value). In another example, adaptive refresh rate controller 320 may calculate the lowest possible refresh rate of display 130 in order to conserve power.

Varying degrees of latency may exist between a time when image data 310 may be displayed on display 130 (e.g., at a default refresh rate or a previously calculated refresh rate), to a time when image data 310 may be displayed on display 130 (e.g., at another refresh rate calculated by adaptive refresh rate controller 320).

Display controller 330 may include any logic capable of processing and/or formatting image data 310. Display controller 330 may reformat image data 310 so that, for example, a driving system (not shown) of display 130 may display image data 310. Display controller 330 may reformat image data 310 received from adaptive refresh rate controller 320. Alternatively, or additionally, display controller may reformat image data 310 from buffer 340. Display controller 330 may read and/or write to buffer 340. Display controller 330 may provide image data 310 to display 130 at a default refresh rate, unless adaptive refresh rate controller 320 provides a refresh rate. The default refresh rate may depend on, for example, the driving system of display 130 and/or column/row display arrays of display 130 (not illustrated). In other words, the default refresh rate of display 130 may be implementation dependent.

In one implementation, display controller 330 may include a timing circuit (not illustrated). The timing circuit may provide synchronous and/or asynchronous indications that may be utilized, for example, for outputting image data 310 to display 130, reading/writing image data 310 to buffer 340, and/or determining if new image data 310 is written to buffer 340. The timing circuit may be controlled by indications from adaptive refresh rate controller 320. For example, adaptive refresh rate controller 320, via the timing circuit, may control the refresh rate of display controller 330.

Buffer 340 may include any mechanism capable of storing image data 310. For example, buffer 340 may be a memory, such as a random access memory (RAM), and may include a memory size capable of storing a frame, a partial frame (e.g., a field), and/or some sort of block size. In one implementation, buffer 340 may operate and store image data 310 corresponding to a data structure, such as a queue.

Display 130 may include any device capable of displaying visual information. In one implementation, display 130 may include a flat panel display (e.g., an electroluminescent display (ELD), a liquid crystal display (LCD), a plasma display panel (PDP), a light emitting diode (LED) display, a non-flat display, such as a cathode ray tube (CRT), or a bi-stable display), a vacuum fluorescent display (VFD), a field emission display (FED), etc. Display 130 may display image data 310 at variable refresh rates. In one implementation, display 130 may include a default refresh rate, and a driver system. The driver system may reformat image data 310 received from display controller 330.

Figure 4:
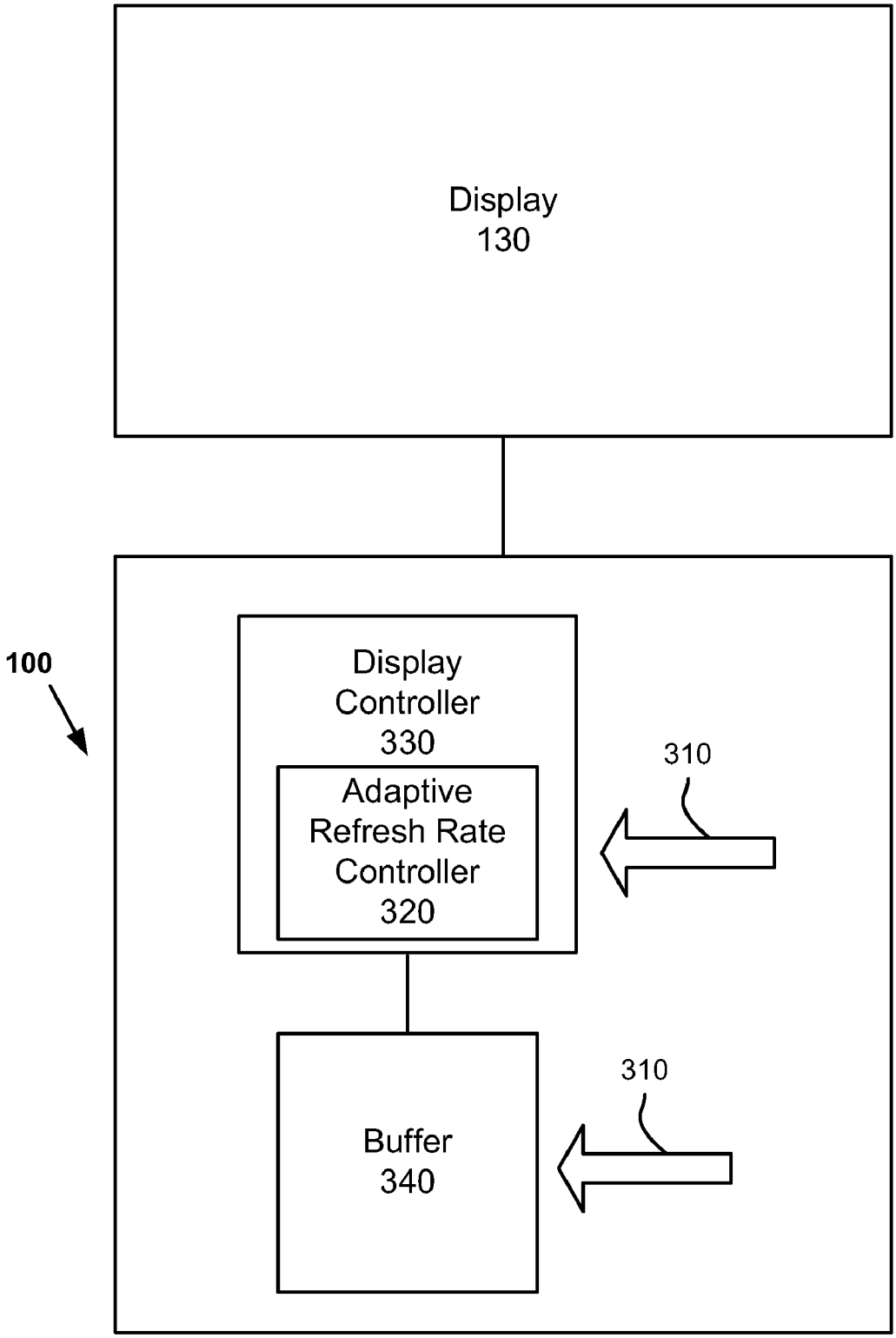
FIG. 4 is a diagram of a second exemplary implementation of the device depicted in FIG. 1.

FIG. 4 illustrates an alternative arrangement of device 100 that may provide adaptive refresh rate features. As illustrated, device 100 may include the components described above in connection with FIG. 3. However, display 130 may be a separate component from device 100, and/or adaptive refresh rate controller 320 may be incorporated within display controller 330. Adaptive refresh rate controller 320 of display controller 330 and/or buffer 340 may receive image data 310. Adaptive refresh rate controller 320, display controller 330, buffer 340, and display 130 may perform the functions described above in connection with FIG. 3. In one implementation, adaptive refresh rate controller 320 may include the timing circuit previously discussed above in connection with FIG. 3.

FIG. 4 further illustrates exemplary connections among display controller 330, buffer 340, and display 130. Connections may perform the functions described above in connection with FIG. 3. Since device 100 does not include display 130, the connection between device 100 and display 130 may be wired or wireless. In one implementation, the connection between device 100 and display 130 may be wired. For example, device 100 may connect to display 130 with a cable. In another implementation, the connection between device 100 and display 130 may be wireless. For example, display 130 may include a wireless component, such as a wireless card (not illustrated). Device 100 may also include a wireless component, such as a wireless card (e.g., communication interface 240). The wireless component may operate in cooperation with other components of display 130, such as the driving system and/or column/row arrays of display 130, as well as in cooperation with display controller 330 of device 100.

Although FIG. 4 shows exemplary components of device 100, in other implementations, device 100 may contain fewer, different, or additional components than depicted in FIG. 4. In still other implementations, one or more components of device 100 may perform the tasks performed by one or more other components of device 100.

Exemplary Method

Figure 5:
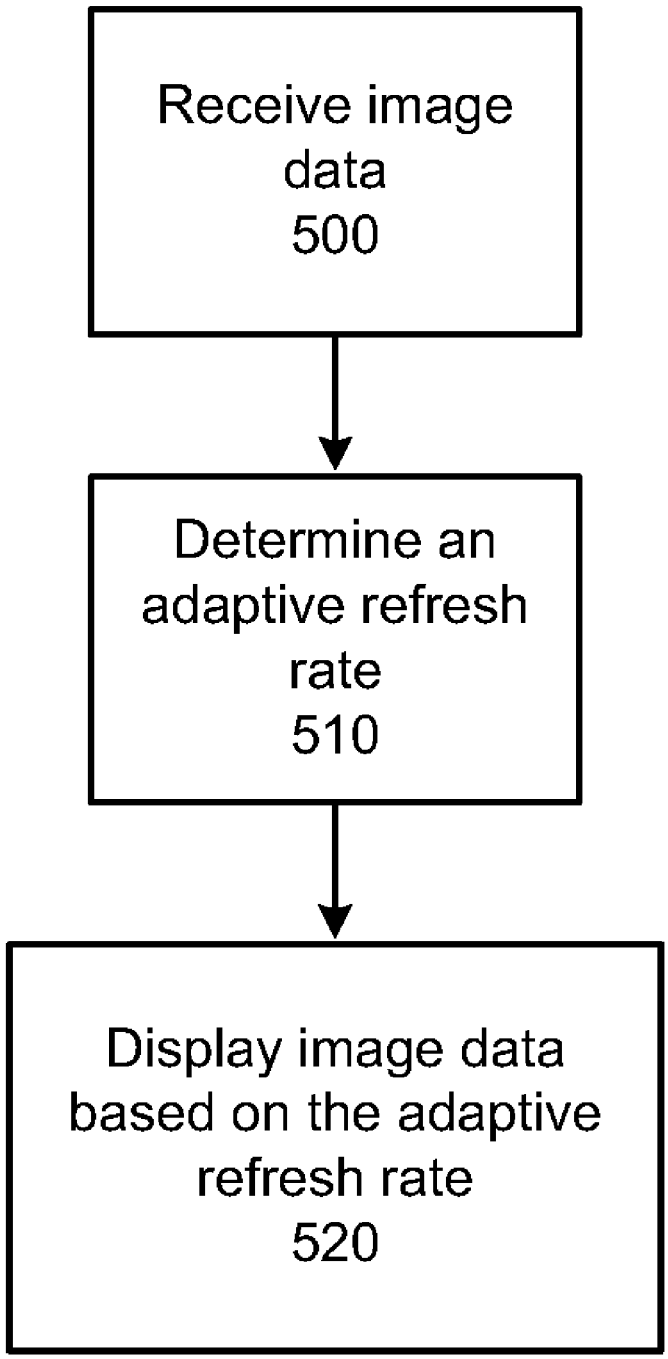
FIG. 5 depicts a flow chart of an exemplary process according to implementations described herein.

FIG. 5 depicts a flow chart of an exemplary process according to implementations described herein. As illustrated, device 100 may receive image data 310 (block 500). In one implementation, image data 310 may be stored in device 100 (e.g., within memory 220 of device 100). In another implementation, device 100 may generate image data 310. For example, device 100 may include an image-capturing component, such as camera 170. In yet another implementation, device 100 may include application software that produces image data 310. In still another implementation, device 100 may receive image data 310 from a source external to device 100 (e.g., a network or another device) via antenna assembly 250.

Device 100 may determine an adaptive refresh rate (block 510). Device 100 (e.g., adaptive refresh rate controller 320) may determine an adaptive refresh rate in various ways. In one implementation, adaptive refresh rate controller 320 may determine an adaptive refresh rate based on image data 310. For example, adaptive refresh rate controller 320 may scan image data 310 and determine an adaptive refresh rate. In another implementation, adaptive refresh rate controller 320 may determine an adaptive refresh rate based on indications from device 100, such as from processing logic 210 and/or other components of device 100. In still another implementation, adaptive refresh rate controller 320 may determine an adaptive refresh rate based on the mode of device 100. In yet another implementation, adaptive refresh rate controller 320 may determine an adaptive refresh rate based on an execution of a software application. In another implementation, adaptive refresh rate controller 320 may determine an adaptive refresh rate based on a power level of a power source of device 100. In yet another implementation, adaptive refresh rate controller 320 may determine an adaptive refresh rate based on converted and/or formatted image data 310. For example, adaptive refresh rate controller 320 may determine an adaptive refresh rate based on reading converted and/or formatted image data 310 stored in buffer 340 by display controller 330. In another implementation, adaptive refresh rate controller 320 may determine an adaptive refresh rate based on reading an output of display controller 330 to display 130.

Device 100 may display image data based on the adaptive refresh rate (block 520). In one implementation, adaptive refresh rate controller 320 may provide an adaptive refresh rate to display controller 330. Display controller 330 may drive display 130 to display image data 310 at the adaptive refresh rate. In another implementation, display controller 330 may include a timing circuit that controls the timing features of display controller 330. In such implementation, adaptive refresh rate controller 320 may control the timing circuit of display controller 330 so that the refresh rate may be adaptively controlled.

EXAMPLE

Figure 6A:
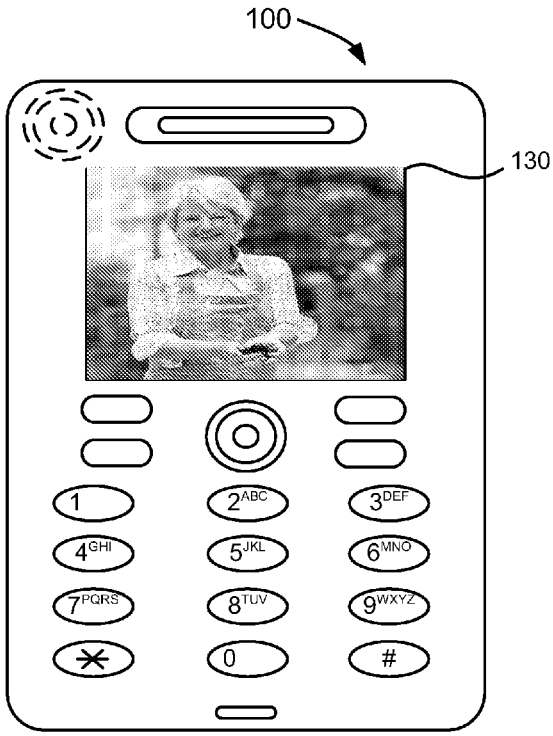
FIG. 6*a* and FIG. 6*b* are exemplary diagrams depicting adaptive refresh rate features from a user's perspective.
Figure 6B:
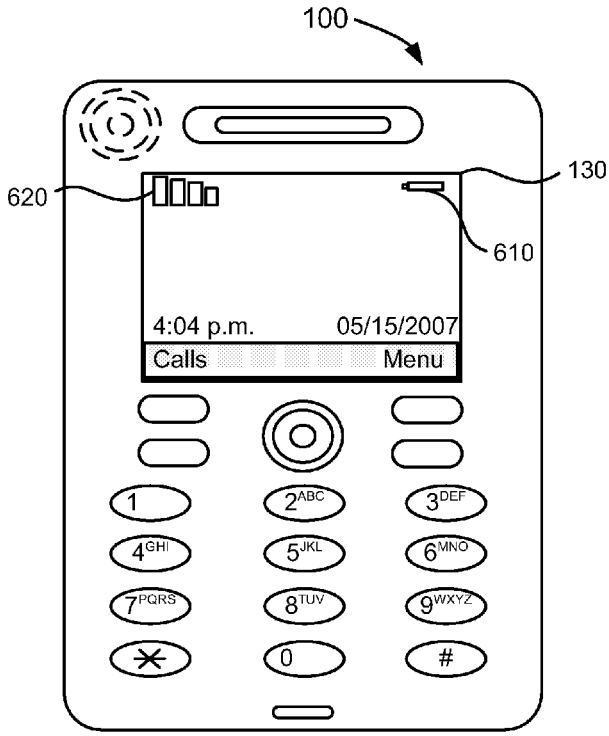

FIGS. 6*a* and 6*b* are exemplary diagrams depicting adaptive refresh rate features with device 100 and from a user's perspective. As illustrated in FIG. 6*a*, the user may be taking a video of his/her mother gardening in the backyard. Image data 310 (i.e., the video) may include a frame rate of 24 fps. Display 130 may include a refresh rate interval of 50-80 Hertz (Hz.). In one implementation, for example, adaptive refresh rate controller 320 may calculate a refresh rate based on the formatted image data 310. For example, adaptive refresh rate controller 320 may calculate a multiple factor of the 24 fps that falls within the refresh rate interval of display 130. Thus, for example, display 130 may operate at a refresh rate of 72 Hz, which is a multiple integer of 24 fps (i.e., 3×24=72). In another implementation, adaptive refresh rate controller 320 may calculate a refresh rate by referring to the table that includes a cross-reference between the camera mode of device 100 and a corresponding refresh rate.

As illustrated in FIG. 6*b*, if the user finishes watching the video of his/her mother gardening in the backyard, display 130 may display semi-static information, such as the date, the time, battery information 610, and strength of wireless connection to a network 620. In one implementation, for example, adaptive refresh rate controller 320 may calculate a refresh rate based on image data 310 (i.e., the semi-static information). For example, adaptive refresh rate controller 320 may scan image data 310 and calculate a refresh rate based on the formatted image data 310. Adaptive refresh rate controller 320 may determine that a minimal refresh rate value would be sufficient since image data 310 is semi-static. Thus, display 130 may operate at the minimal refresh rate (e.g., at a refresh rate of 50 Hz).

CONCLUSION

Implementations described herein may include a device capable of providing adaptive refresh rate features.

The foregoing description of exemplary embodiments provides illustration and description, but is not intended to be exhaustive or to limit the invention to the precise form disclosed. Modifications and variations are possible in light of the above teachings or may be acquired from practice of the invention. For example, while a series of acts and/or processes have been described with regard to FIG. 5, the order of the acts and/or processes may be modified in other implementations.

It should be emphasized that the term "comprises" or "comprising" when used in the specification is taken to specify the presence of stated features, integers, steps, or components but does not preclude the presence or addition of one or more other features, integers, steps, components, or groups thereof.

It will be apparent that aspects, as described above, may be implemented in many different forms of software, firmware, and hardware in the implementations illustrated in the figures. The actual software code or specialized control hardware used to implement these aspects is not limiting of the invention. Thus, the operation and behavior of these aspects were described without reference to the specific software code--it being understood that software and control hardware could be designed to implement these aspects based on the description herein.

No element, act, or instruction used in the present application should be construed as critical or essential to the invention unless explicitly described as such. Also, as used herein, the article "a", "an", and "the" are intended to include one or more items. Where only one item is intended, the term "one" or similar language is used. Further, the phrase "based on" is intended to mean "based, at least in part, on" unless explicitly stated otherwise.

As used herein, the term "and/or" includes any and all combinations of one or more of the associated list items.

What is claimed is:

1. A device, comprising:
one or more devices to provide image data;
a refresh rate controller to:
receive the image data from the one or more devices,
scan the image data to determine that the image data is in a raw format, and that a particular type of the image data cannot be identified by the refresh rate controller, and
forward the image data;
a display controller to:
receive the image data from the refresh rate controller,
reformat the image data to a standardized format, and
write the reformatted image data to a buffer of the device, where the refresh rate controller is further to:
read the reformatted image data from the buffer,
determine the particular type of the image data, and
calculate a particular refresh rate corresponding to the particular type of the image data; and
a display to present the image data at the particular refresh rate.

2. The device of claim 1, wherein the particular refresh rate controller further calculates the particular refresh rate based on a particular property of the image data.

3. The device of claim 1, wherein the particular refresh rate controller further calculates the particular refresh rate based on format identifiers within the image data.

4. The device of claim 1, wherein the refresh rate controller further calculates the particular refresh rate based on a current operating mode of the device.

5. The device of claim 1, wherein the refresh rate controller further calculates the particular refresh rate based on execution of a software application in the device.

6. The device of claim 1, further comprising:
a power supply, wherein the refresh rate controller further calculates the particular refresh rate based on an available power level of the power supply.

7. The device of claim 1, wherein the device further comprises:
a memory that stores a database that includes device mode information and corresponding refresh rates, where the refresh rate controller references the memory to calculate the particular refresh rate.

8. A system, comprising:
a display to present image data at variable refresh rates; and
a device comprising:
a refresh rate controller to:
scan the image data to determine that the image data is in a raw format, and that a particular type of the image data cannot be identified, and
forward the image data; and
a display controller to:
receive the image data from the refresh rate controller,
reformat the image data to a standardized format, and
output the reformatted image data, wherein the refresh rate controller is further to:
determine the particular type of the reformatted image data,
calculate a particular refresh rate based on the particular type of the reformatted data image, and
cause the display to present the reformatted image data at the particular refresh rate.

9. The system of claim 8, wherein the display and the device communicate with each other via a wireless connection.

10. A method performed by a device, comprising:
providing, by one or more components of the device, image data in a particular format;
determining, by one or more components of the device, that the one or more components are unable to identify a type of the image data in the particular format;
converting, by one or more components of the device, the image data from the particular format to an identifiable format;
identifying, by one or more components of the device and using the identifiable format, the type of the image data;

selecting, by one or more components of the device, a particular refresh rate, from a plurality of refresh rates, based on the type of the image data and at least one of:
the image,
a current mode of the device,
execution of particular software by the device, or
a current power level of a power supply of the device; and
displaying the image data, on a display of the device, based on the particular refresh rate.

11. The method of claim 10, further comprising:
scanning the image data;
identifying a format identifier within the scanned image data, and
determining, based on the format identifier, that a type of the image data cannot be identified.

12. The method of claim 10, wherein selecting a particular refresh rate comprises:
accessing a database comprising device modes and corresponding refresh rates, and
determining that the particular refresh rate corresponds to the current mode of the device.

13. The method of claim 10, wherein selecting a particular refresh rate comprises:
accessing a database comprising software identification information and corresponding refresh rates, and
determining that the particular refresh rate corresponds to the particular software.

14. The method of claim 10, wherein selecting a particular refresh rate comprises:
determining the current power level of the power supply of the device; and
comparing the current power level to a threshold value.

15. The method of claim 14, wherein selecting a particular refresh rate comprises:
selecting a lowest refresh rate, from the plurality of refresh rates, as the particular refresh rate, when the current power level is below the threshold value.

16. A non-transitory computer-readable medium having stored thereon sequences of instructions which, when executed by at least one processor, cause the at least one processor to:
provide image data in a particular format;
determine that a type of the image data cannot be identified using the particular format;
convert the image data from the particular format to an identifiable format;
identify the type of the image data using the identifiable format;
select a particular refresh rate from a plurality of refresh rates, based on the type of the image data and at least one of:
a current mode of the device,
execution of particular software by the device, or
a current power level of a power supply of the device; and
display the image data at the particular refresh rate.

17. A device, comprising:
means for providing image data in a particular format;
means for determining that a type of the image data cannot be identified using the particular format;
means for converting the image data from the particular format to an identifiable format;
means for identifying the type of the image data using the identifiable format;
means for selecting a particular refresh rate from a plurality of refresh rates, based on the type of the image data and at least one of:
a current mode of the device,
execution of particular software by the device, or
a current power level of a power supply of the device; and
means for displaying the image data at the particular refresh rate.

* * * * *